US011602865B2

(12) United States Patent
Novak et al.

(10) Patent No.: US 11,602,865 B2
(45) Date of Patent: Mar. 14, 2023

(54) HAIR CLIPPER WITH TAPERED RADIAL HANDLE

(71) Applicant: Andis Company, Sturtevant, WI (US)

(72) Inventors: Joseph Novak, Milwaukee, WI (US); Evan Cutter Waller, Kenosha, WI (US); Andreas Lundbäck, Stockholm (SE); Viktor Berglin, Stockholm (SE)

(73) Assignee: Andis Company, Sturtevant, WI (US)

( * ) Notice: Subject to any disclaimer, the term of this patent is extended or adjusted under 35 U.S.C. 154(b) by 0 days.

(21) Appl. No.: 17/318,690

(22) Filed: May 12, 2021

(65) Prior Publication Data

US 2022/0184833 A1 Jun. 16, 2022

Related U.S. Application Data

(63) Continuation-in-part of application No. 29/761,648, filed on Dec. 10, 2020.

(51) Int. Cl.
*B26B 19/38* (2006.01)
*B26B 19/12* (2006.01)

(52) U.S. Cl.
CPC ..... *B26B 19/3853* (2013.01); *B26B 19/12* (2013.01); *B26B 19/3873* (2013.01)

(58) Field of Classification Search
CPC .. B26B 19/3853; B26B 19/12; B26B 19/3873
(Continued)

(56) References Cited

U.S. PATENT DOCUMENTS 1,158,741 A * 11/1915 Stearns et al. ..... B26B 21/38 30/34.05
1,337,166 A * 4/1920 Toles ..... B26B 21/38 30/44

(Continued)

FOREIGN PATENT DOCUMENTS

AU 202112652 8/2021
AU 202114613 9/2021

(Continued)

OTHER PUBLICATIONS

Andis Releases New Cordless Clipper with 5-Position Blade for Small Animal Groomers—petsplusmag.com, published May 10, 2021, retrieved on Jan. 28, 2022, retrieved from the Internet URL: https://petsplusmag.com/andis-releases-new-cordless-clipper-with-5-position-blade-for-small-animal-groomers/.

(Continued)

*Primary Examiner* — Omar Flores Sanchez
(74) *Attorney, Agent, or Firm* — Reinhart Boerner Van Deuren s.c.

(57) ABSTRACT

A haircutter handle has upper and lower housings. The upper housing and lower housing join to form a circumvoluted and/or spiraled exterior surface. The handle narrows and extends axially from a blade end to a handle or gripping end. The blade has an upper blade that oscillates over the lower blade to cut hair. The handle has a reduction taper that facilitates gripping and/or handling the handle. The taper also orients the motor and battery so that the center of gravity is positioned within the palm of the user's hand when gripping the handle. The blade end of the handle has a width and/or height that are greater than a width and/or height at the handle end. The reduction in height and/or width dimensions define a taper. In some embodiments, the width tapers (Continued)

more than the height tapers to facilitate gripping the handle about the center of gravity.

8 Claims, 8 Drawing Sheets

(58) Field of Classification Search
USPC .. 30/42, 43, 43.1–43.9, 43.91, 43.92, 44–46
See application file for complete search history.

(56) References Cited

U.S. PATENT DOCUMENTS 1,384,044 A * 7/1921 Burke ..... B26B 21/36 30/46
1,679,670 A * 8/1928 King ..... B26B 21/36 30/59
1,690,133 A * 11/1928 Schick ..... B26B 19/08 30/220
1,719,827 A * 7/1929 Aron ..... B26B 21/38 30/346.5
2,015,160 A * 9/1935 Shaler ..... B26B 21/38 30/45
2,741,026 A * 4/1956 Guenther ..... B26B 19/06 30/210
D188,459 S * 7/1960 Jepson et al. ..... D28/51
3,081,782 A * 3/1963 Funk ..... A45D 29/05 30/34.05
3,196,539 A * 7/1965 Jepson et al. ..... B26B 19/12 D28/51
3,287,805 A * 11/1966 Du Charme ..... B26B 19/20 30/41.5
4,835,861 A * 6/1989 Mahlich ..... B26B 19/3813 30/43.92
D302,743 S 8/1989 Wahl et al.
D405,924 S 2/1999 Lebherz
D522,694 S 6/2006 Shin
D681,276 S 4/2013 Colle
D784,618 S 4/2017 Mori et al.
D851,835 S 6/2019 Gross
D865,292 S 10/2019 Peterson, Jr.
D910,918 S 2/2021 Jiang
D910,920 S 2/2021 Jiang
D930,244 S 9/2021 Cai
D936,901 S 11/2021 Ji
2014/0221749 A1* 8/2014 Grant et al. ..... A61B 1/00096 600/109
2017/0078583 A1* 3/2017 Haggerty et al. .. A61B 1/00071
2018/0290317 A1 10/2018 Takada et al.

FOREIGN PATENT DOCUMENTS

CN 202130340691.0 11/2021
GB 6136636 5/2021
GB 6136637 5/2021
GB 6136638 5/2021
GB 6136639 5/2021
WO 2015/134110 * 9/2015 ..... B26B 19/3853

OTHER PUBLICATIONS

U.S. Appl. No. 29/761,648, filed Dec. 10, 2020, Andis Company.

* cited by examiner

HAIR CLIPPER WITH TAPERED RADIAL HANDLE

CROSS-REFERENCE TO RELATED PATENT APPLICATION

This application is a Continuation-in-Part of U.S. Design application Ser. No. 29/761,648, filed Dec. 10, 2020, which is incorporated herein by reference in its entirety.

BACKGROUND OF THE INVENTION

The present invention relates generally to the field of haircutters or clippers. The present invention relates specifically to hair clippers with a modified housing.

SUMMARY OF THE INVENTION

One embodiment of the invention relates to a haircutter having a blade assembly and a handle. The blade assembly defines a cutting end with a stationary blade and an oscillating blade that oscillates cutting teeth over the stationary blade to cut hair. The handle has an upper and lower housing, each having a spiral (e.g., circumvoluted) exterior surface. The handle defines a height taper and a width taper to form a gripping end opposite the blade assembly. The user grasps the gripping end to operate the haircutter. The reduction from a maximum height of the handle to a height at the gripping end defines the height taper. The reduction from a maximum handle width to the width at the gripping end defines the width taper. The width taper is greater than the height taper, such that the handle width reduces more than the handle height.

Another embodiment of the invention relates to a haircutter having a handle coupled to a blade assembly. T handle has a first end defining a first width and a first height. Similarly, a second end opposite the first end defines a second width and a second height. The handle has a taper, such that the first width and the first height are greater than the second width and the second height. The blade assembly is coupled to the handle at the first end and has a first oscillating blade and a second stationary blade. The first blade has oscillating teeth extending along an edge of the first blade. Similarly, the second blade has teeth extending along a second blade edge that is oriented parallel to the first blade edge. The distance between the first and second blade edges defines a blade gap. A lever is coupled to the first blade to move the first blade edge relative to the second blade edge. In other words, the lever's movement increases or decreases the blade gap and thereby adjusts the length of hair cut by the blade assembly.

Another embodiment of the invention relates to a haircutter having a clamshell handle and a blade assembly. The clamshell handle has an upper housing and a lower housing. Each has a spiral exterior surface and extends axially between a first end and a second end opposite the first end. The clamshell handle couple's upper and lower housings to define a tapered handle having a width at the first end that is greater than a width at the second end. The reduction of the handle width defines a width taper. Similarly, a height at the first end is greater than a height at the second end. The reduction of the handle height defines a height taper. The width taper is greater than the height taper. The blade assembly is coupled to the first end of the handle and has a first blade and a second blade. The first blade has teeth that extend along a first blade edge. The first blade oscillates the teeth in a direction parallel to the first blade edge. Similarly, the second blade has teeth that extend along a second blade edge that is parallel to the first blade edge. The distance between the first blade edge and the second blade edge defines a blade gap. A lever is coupled to the first blade to move the first blade edge in an orthogonal direction relative to the oscillating direction. Moving the first blade edge increases or decreases the blade gap between the edges of the first blade and the second blade.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
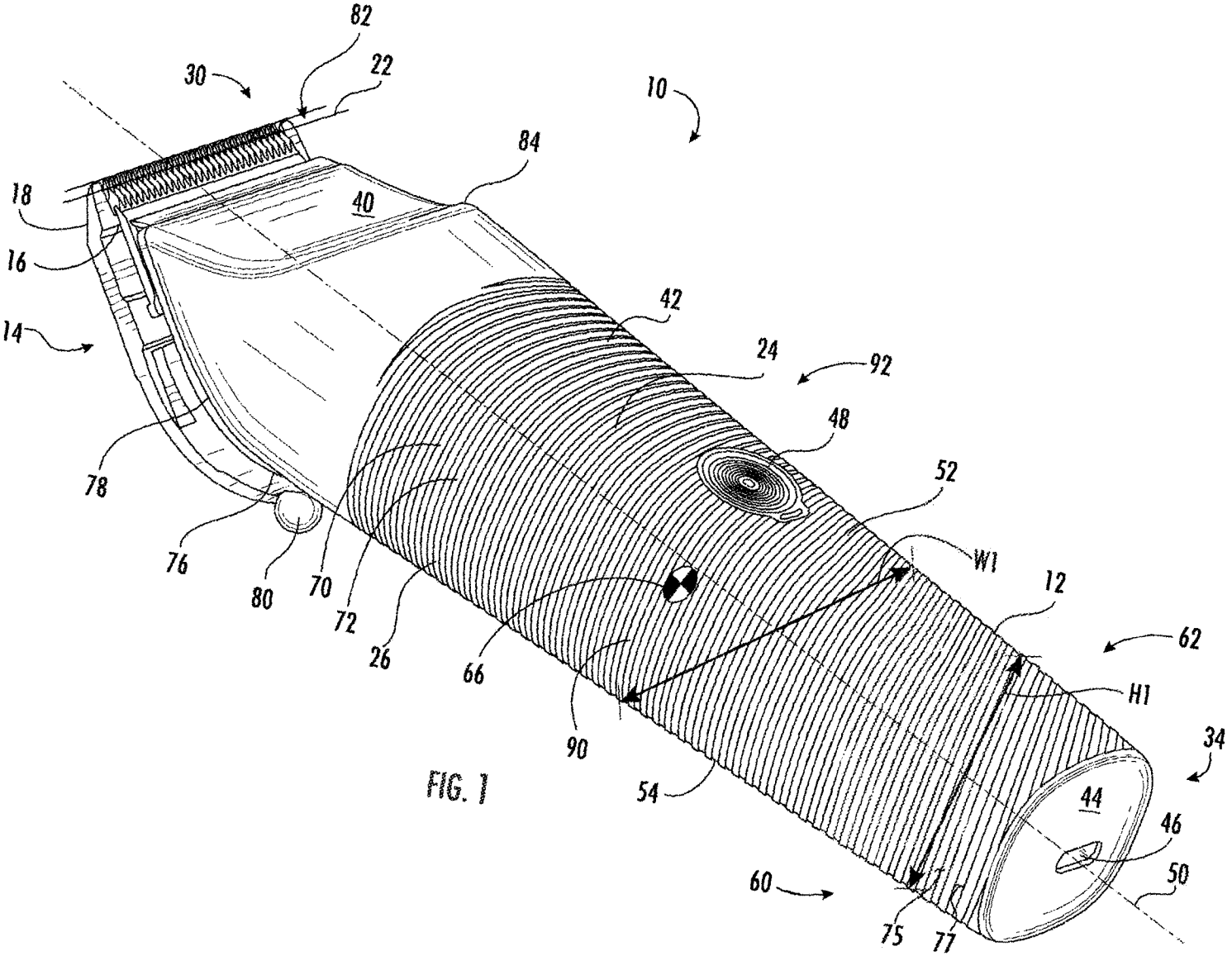
FIG. 1 is a top perspective view of a hair clipper, according to an exemplary embodiment.
Figure 2:
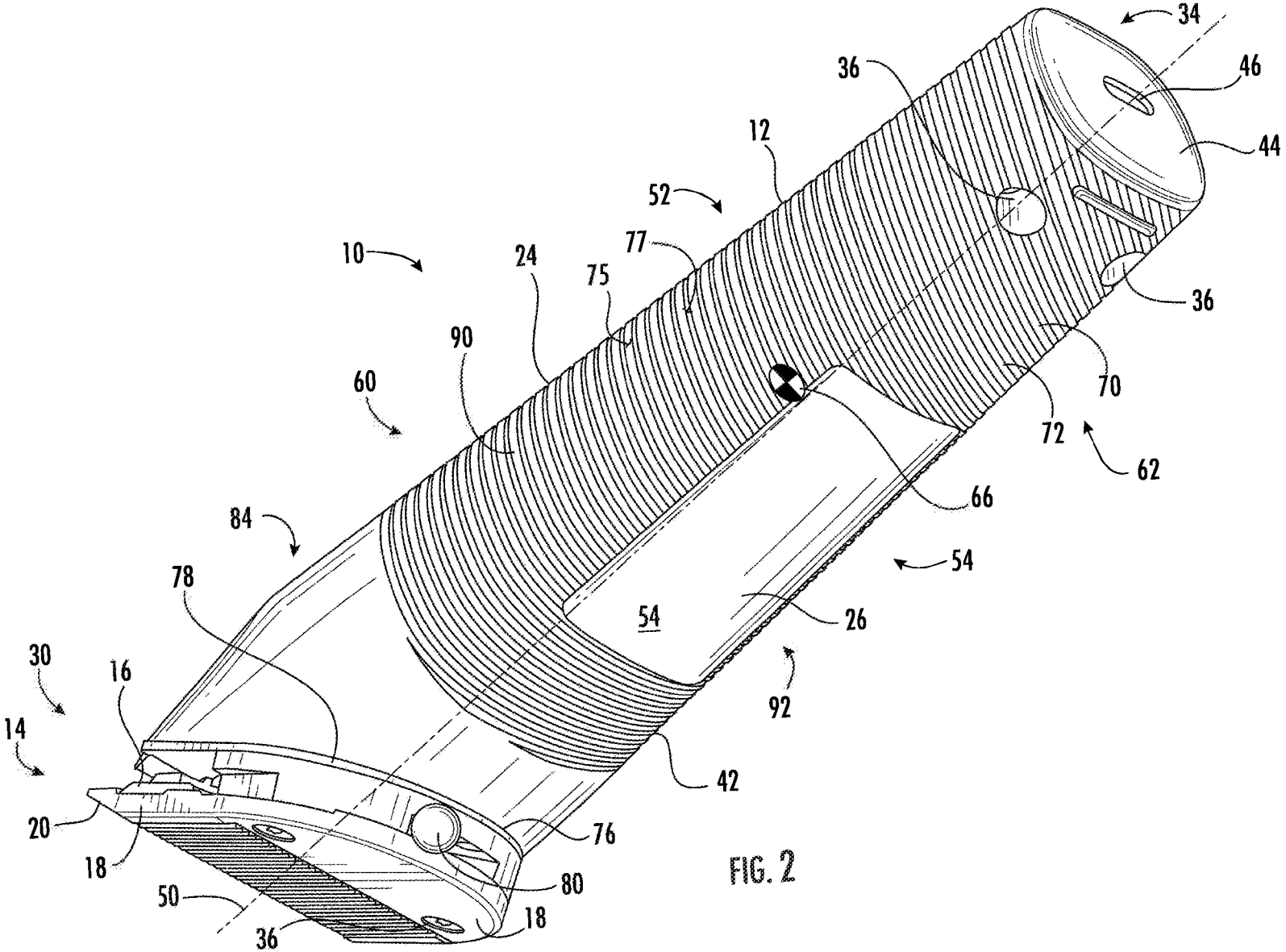
FIG. 2 is a bottom perspective view of the hair clipper of FIG. 1.
Figure 3:
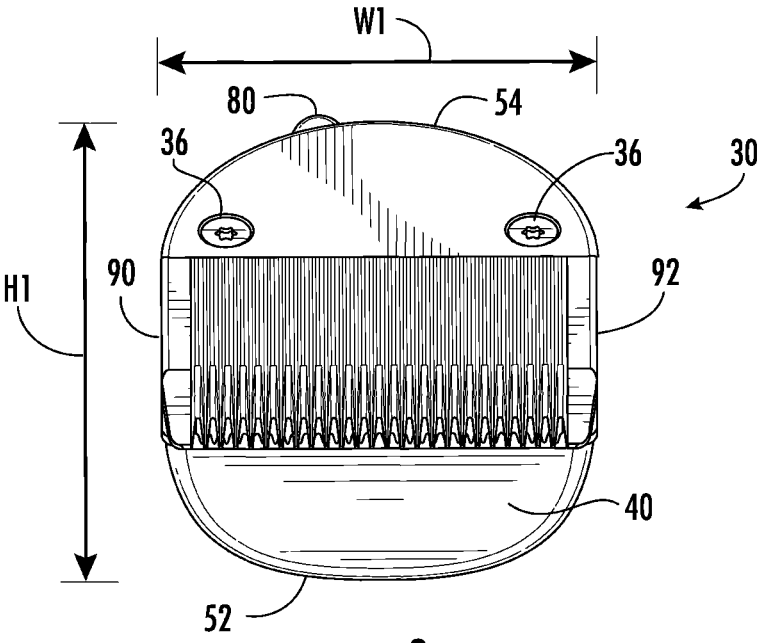
FIG. 3 is a front side view of the hair clipper of FIG. 1.
Figure 4:
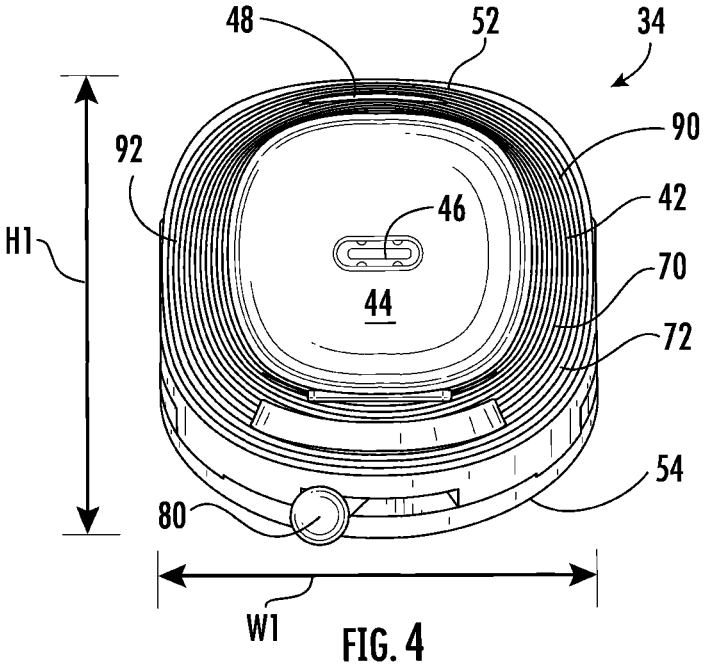
FIG. 4 is a rear side view of the hair clipper of FIG. 1.
Figure 5:
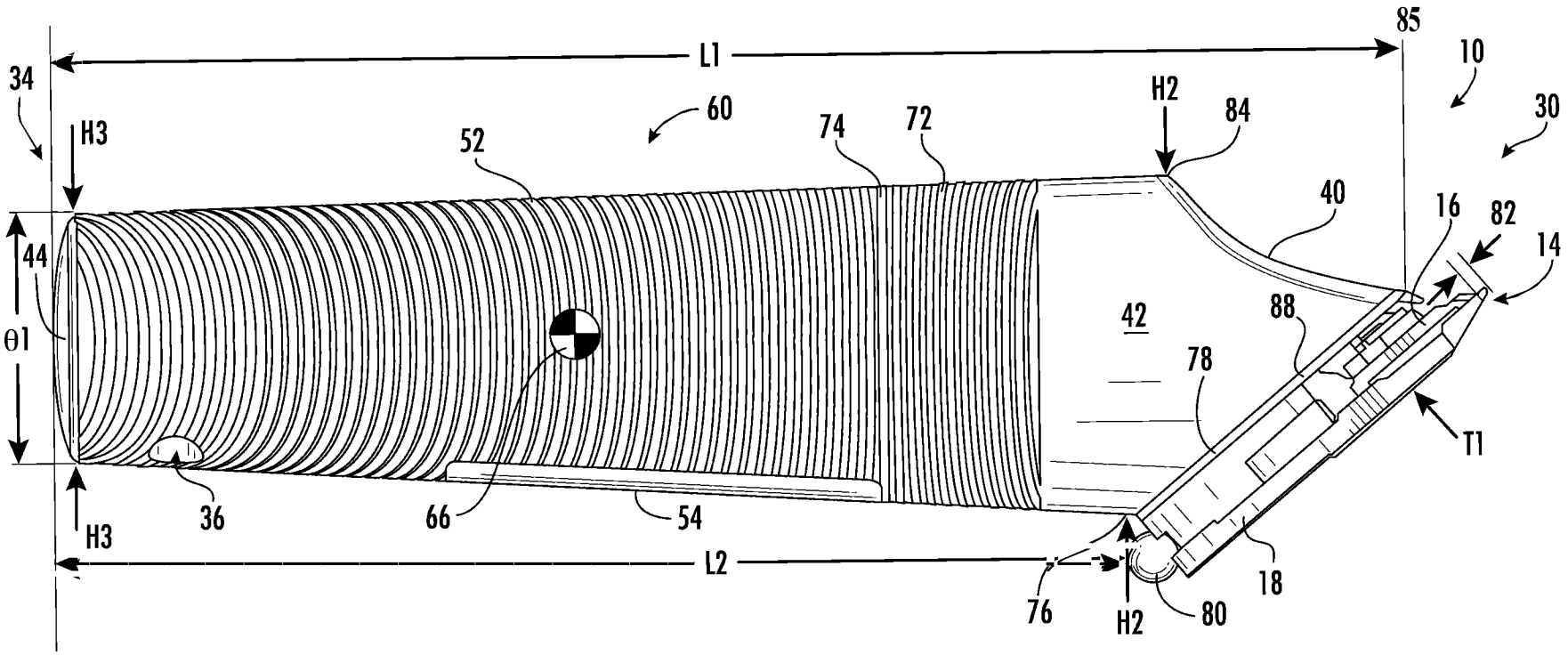
FIG. 5 is a right side view of the hair clipper of FIG. 1.
Figure 6:
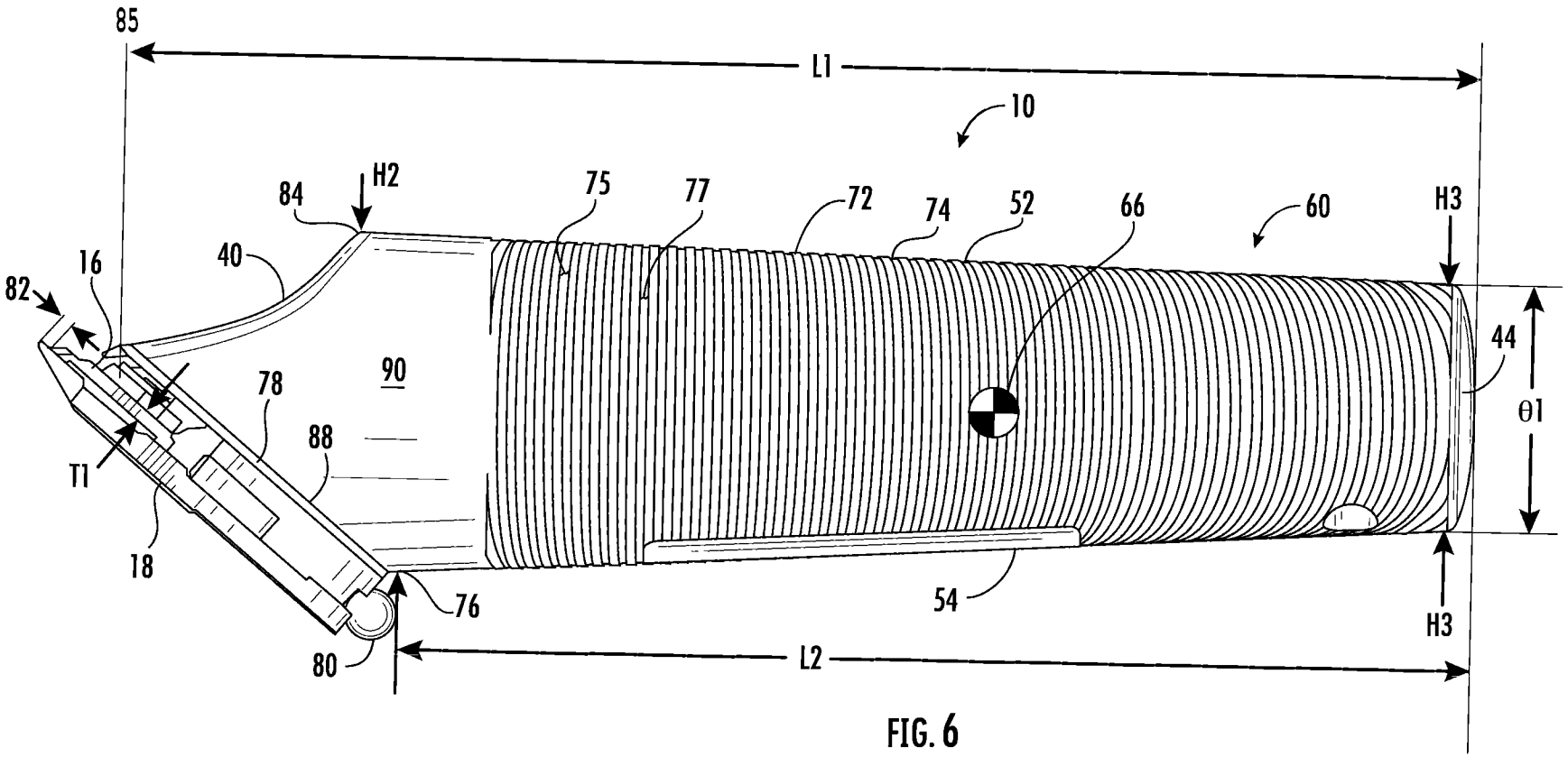
FIG. 6 is a left side view of the hair clipper of FIG. 1.

Referring to FIGS. 1 and 2, a hair trimmer, clipper, or clipper 10 shows a handle 12 coupled to a blade assembly 14 with a cutting upper blade or cutter 16 and a stationary outer or lower blade 18. Clipper 10 has a handle 12 and a blade assembly 14. Blade assembly 14 includes a stationary blade 18 and an oscillating cutter 16 to cut hair as teeth 20 of cutter 16 oscillate over stationary blade 18. Cutter 16 has teeth 20 extending from a cutter blade edge 22 and defining a first direction parallel to width W1 of handle 12. In other words, as cutter 16 oscillates over stationary blade 18 in the first direction, the teeth 20 on cutter 16 and blade 18 capture hair follicles and cooperate to cut hair.

Figure 9:
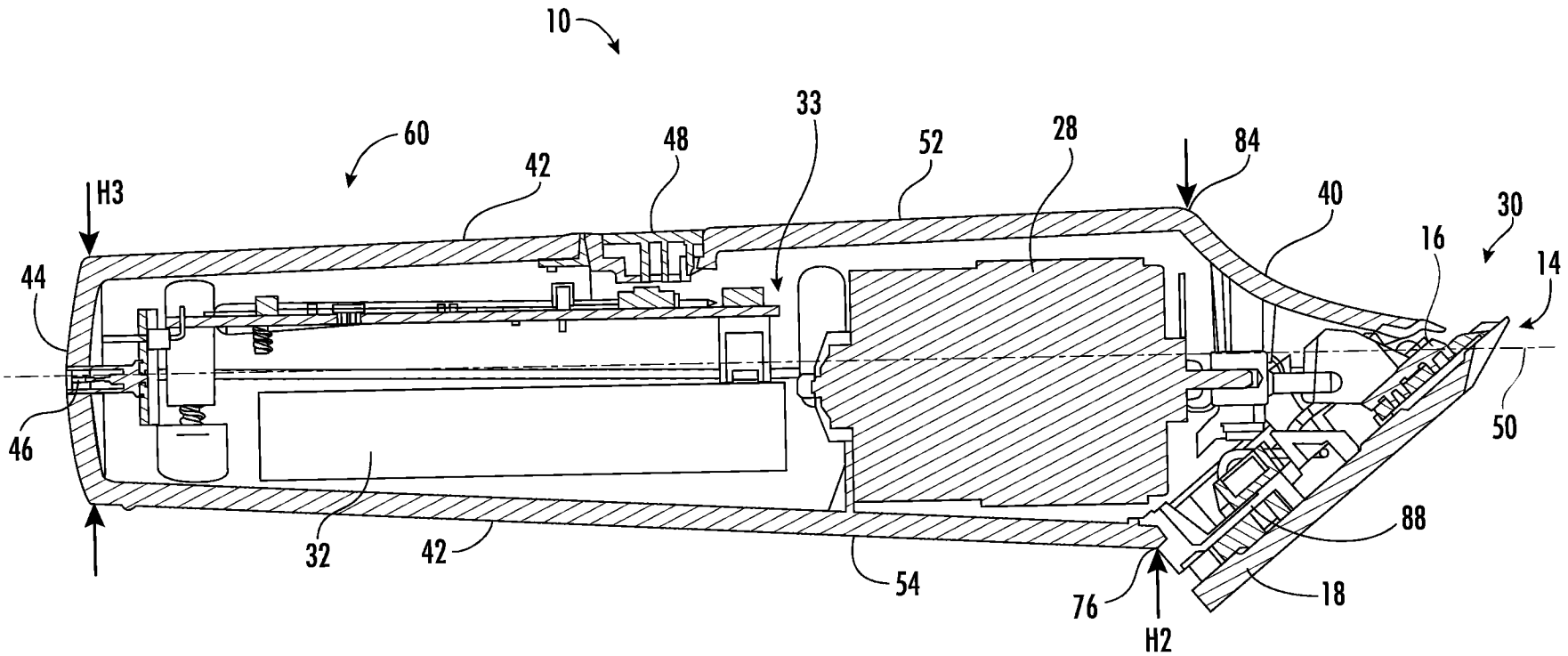
FIG. 9 is a cross-sectional view of the hair clipper of FIG. 1.

FIG. 1 shows a handle 12 with an upper housing 24 and a lower housing 26. Applicant has found that reducing dimensions of the handle 12 (e.g., along the upper and lower housings 24 and 26 to create a taper) enhances the balance of the clipper 10. For example as shown in FIG. 9, the weight of the blade assembly 14 and a motor 28 near the cutting end 30 is offset by a counterweight provided by an internally housed battery 32 at a gripping end 34 of handle 12. For example, rotary motor 28 is captured near blade assembly 14 and located in a cavity near the front 45% of upper housing 24 and lower housing 26. Specifically, reducing or tapering the width and/or height dimensions of clipper 10 enables motor 28 to be housed within an internal cavity 33 near cutting end 30 and extended or elongated battery 32 to be captured/housed within internal cavity 33 near the gripping end 34.

Handle 12 has a first end or cutting end 30 with a width dimension and a height dimension that are greater than the width and height dimensions at a second or gripping end 34. Gripping end 34 is located longitudinally opposite cutting end 30 and has a second width and height dimensions that are less than the width and height dimensions of cutting end 30.

In various embodiments, handle 12 is a single, continuous, and/or integral part, such that upper housing 24 and lower housing 26 are permanently joined and/or fabricated as an integral continuous component or unitary part. In other embodiments, upper housing 24 is fabricated separately from lower housing 26 and joined or coupled to form handle 12, e.g., using fasteners 36 (FIG. 2). For example, a clamshell handle 12 has an upper housing 24 and lower housing 26 coupled with fasteners 36.

A hair shield 40 is formed on an exterior surface 42 of upper housing 24. Hair shield 40 defines a concave depression on a surface of upper housing 24 that prevents cut hair or other debris from entering internal cavity 33 and interfering with rotary motor 28 (FIG. 9). In other words, hair shield 40 forms a concave hair shield surface that captures and/or deflects hair and other debris away from internal cavity 33 of handle 12 and/or rotary motor 28.

At the opposite handle gripping end 34, a base 44 of handle 12 has an electric charging port 46. Charging port 46 extends through handle 12 and is electronically coupled to a battery 32 located within internal cavity 33. As shown in FIGS. 1 and 2, a circular power button 48 within upper housing 24 electronically couples battery 32 to control board and selectively controls motor 28, e.g., controls rotary speed and/or powers motor 28 on/off. In one embodiment, power button 48 is located in upper housing 24 and has a diameter D1 equal to or less than 0.5 inches.

Handle 12 extends along a longitudinal or axial axis 50 extending from a cutting end 30 to a gripping end 34 and defining a housing length L1 in the axial direction. An orthogonal angle to axial axis 50 defines a housing width W1 (e.g., between left and right sides of handle 12), and a housing height H1 (e.g., between the top side 52 and the bottom side 54 of handle 12) are also defined. Handle 12 includes a height taper 60 and/or width taper 62 from cutting end 30 to handle gripping end 34. Height taper 60 is the reduction from maximum height H2 at cutting end 30 between upper housing 24 and lower housing 26, and width taper 62 is the reduction from maximum width W2 of handle 12 near cutting end 30—between upper housing 24 and lower housing 26. Height taper 60 and/or width taper 62 adjust height H1 and width W1 dimensions of handle 12 and define the location and/or position of the center of gravity 66 of clipper 10 within handle 12. Applicant has found that these features enhance gripping and facilitate grasping clipper 10 for long durations.

Specifically, Applicant has found that height taper 60 and/or width taper 62 (e.g., a reduction in height H1 and/or width W1 dimensions along axial axis 50) enhances the position of a center of gravity 66. In other words, the taper comfortably locates the center of gravity 66 of the clipper 10 within a user's hand for grasping and manipulating clipper 10. In addition, the taper changes the size of hair shield 40 relative to the maximum width W2. Specifically, the taper maximizes the shield's width to enhance motor 28 protection in cavity 33 of handle 12. Ridges 70 and/or grooves 72 on exterior surface 42 enhance a user's grasp by increasing friction. Ridges 70 and grooves 72 alternate to create an alternating spiral ridge 70 and spiral groove 72. In some embodiments, ridges 70 and/or grooves 72 are formed from a molded polymer or thermoset plastic.

Grasping friction is enhanced when grooves 72 spiral spacing 75 is equal to the ridges 70 spiral thickness 77. The spiral spacing 75 of grooves 72 and/or thickness 77 of the spiral ridges is less than or equal to 0.05 inches in one embodiment. In one embodiment, the spiral spacing 75 of grooves 72 is defined as the distance between two adjacent ridges 70. Similarly, the ridge 70 thickness 77 equals the thickness 77 of the spiral ridges 70. In various embodiments, the spacing 75 of spiral grooves 72 is equal to the thickness 77 of spiral ridges 70 and is less than or equal to 0.05 inches. In a specific embodiment, the spacing 75 of grooves 72 and/or thickness 77 of ridges 70 is equal to 0.04 inches.

Figure 7:
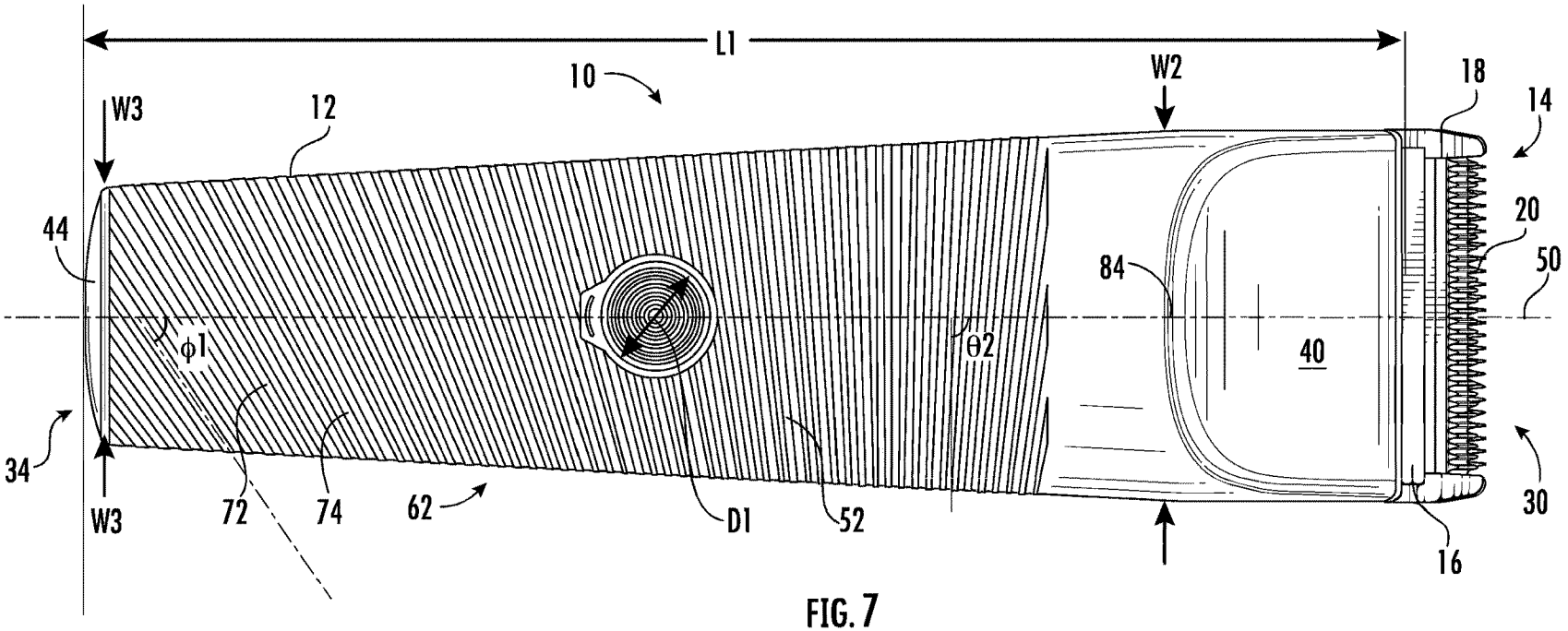
FIG. 7 is a top side view of the hair clipper of FIG. 1.
Figure 8:
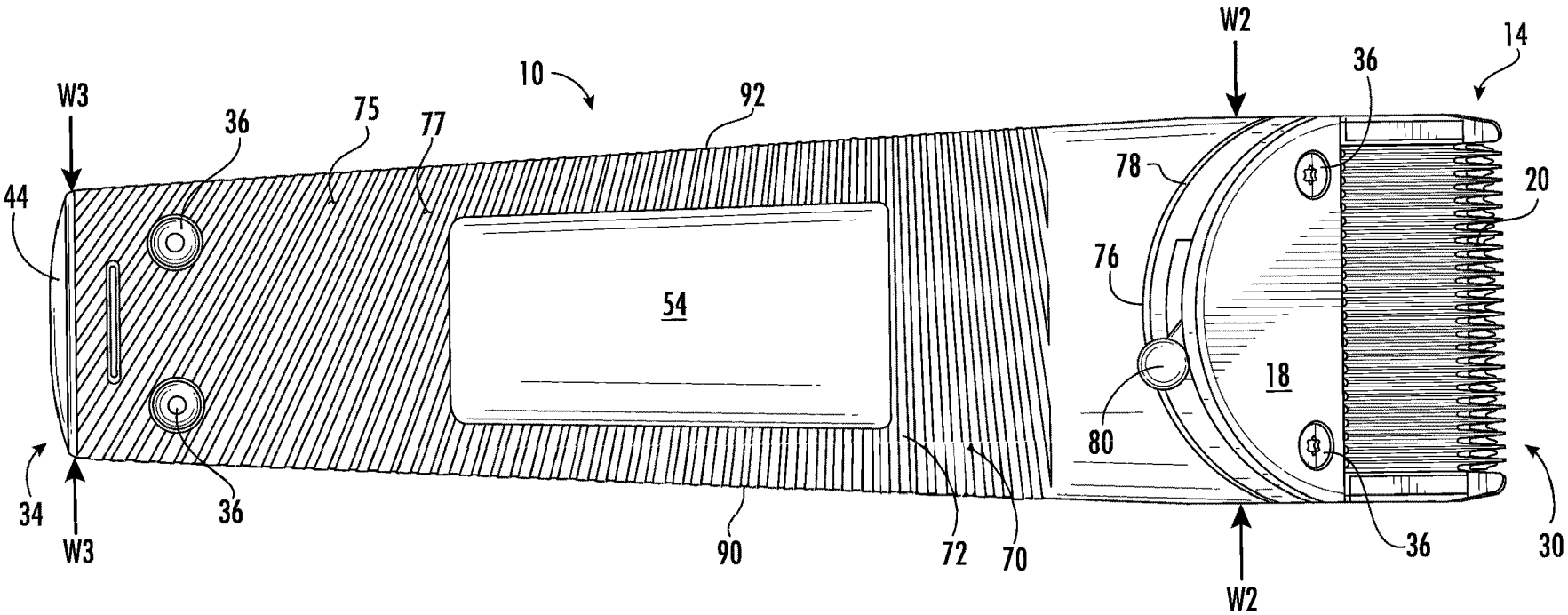
FIG. 8 is a bottom side view of the hair clipper of FIG. 1.

For example, upper housing 24 and lower housing 26 have a circumvoluted or spiral exterior surface 42 with spiraled ridges 70 and/or grooves 72 to increase friction on exterior surface 42. Exterior surface 42 of upper housing 24 aligns with the spiral exterior surface 42 of lower housing 26 to collectively form an enhanced grip on handle 12. In other words, the spiral exterior surface 42 of handle 12 enhances the user's grip on handle 12. In one embodiment, an angle $\ominus$ formed by ridges 70 relative to axial axis 50 is greater nearer the cutting end 30 where a user is less likely to grip than angle $\ominus$ formed by the spiral ridge 70 nearer gripping end 34 (see $\phi$1 and $\theta$2 of FIG. 7). In other words, the spiral ridge 70 changes direction relative to the longitudinal direction of handle 12 as the hand moves closer or farther from the center of gravity 66 in the gripping end 34 of handle 12. In this way, the spiral direction and/or orientation of the ridges 70 directs the user to grasp handle 12 more efficiently.

FIG. 2 shows a bottom perspective view of hair clipper 10. Height taper 60 and width taper 62 are shown extending away from blade assembly 14 to reduce height H1 and/or width W1 dimensions of handle 12 nearer base 44. This configuration provides a narrower handle 12 at gripping end 34 to facilitate grasping handle 12 by a user. Also, positioning components of the blade assembly 14, motor 28, and battery 32 within handle 12 locate a center of gravity 66 within the grasping or gripping end 34 of handle 12. Blade assembly 14 is coupled to handle 12 and extends angularly along handle 12 from a bend 76 of lower housing 26. Upper housing 24 extends further along axial axis 50 (e.g., in the longitudinal direction) than lower housing 26 to create an angular or angled recess 78 in lower housing that captures and/or couples lower housing 26 of handle 12 to blade assembly 14.

A fixed lower blade 18 is coupled to handle 12 (e.g., on upper/lower housing 24 and/or 26), and cutter 16 is coupled to blade assembly 14 and oscillates over blade 18 in a direction parallel to blade edges 22 (e.g., in a direction parallel to the width W1 of handle 12). As described in greater detail below, a lever 80 is coupled to cutter 16 that translates cutter 16 over lower blade 18 in an orthogonal direction to the oscillation direction of blade edge 22. Moving or rotating lever 80 translates cutter 16 in a transverse direction orthogonal to blade edge 22. The cutter 16 translation increases or decreases a blade gap 82 between the cutter blade edge 22 and lower blade edge 22.

Cutter 16 translates to change a gap 82 between the cutting edges of cutter 16 and blade 18. Changing gap 82 between upper and lower blade edges 22 modifies the length of hair cut by blade assembly 14. Specifically, a shorter gap 82 between the blade edges 22 enables the combined thickness T1 of the cutter 16 and blade 18 (e.g., blade assembly 14) to create a more extended length cut. Similarly, a longer gap 82 between the blade edges 22 reduces the combined thickness T1 of blade assembly 14 between the cutter 16 and blade 18 and results in a shorter length cut. In various embodiments, blade assembly 14 has a combined thickness T1 between 0.1 and 0.4 inches, specifically between 0.2 and 0.3 inches, and more specifically, between 0.22 inches and 0.25 inches.

FIGS. 3-9 illustrate different orthogonal views of hair clipper 10 and demonstrate relative and absolute clipper 10 dimensions. The shape and scale of height and width tapers 60 and 62 are shown, as well as the relationship of handle 12 relative to blade assembly 14. Handle length L1 is defined as the minimum distance from a base 44 of handle 12 at the gripping end 34 to a distal end 85 of projection 84 at cutting end 30. In other words, handle length L1 is measured along (e.g., parallel to) axial axis 50.

Similarly, a lower housing length L2 is defined along axial axis 50 from base 44 to a bend 76 on lower housing 26 near cutting end 30. Bend 76 defines a blade surface 88 on the handle 12 between bend 76 on lower housing 26 and projection 84 on upper housing 24. Blade surface 88 couples lower blade 18 of blade assembly 14 to handle 12.

Hair shield 40 is located adjacent to blade surface 88 on upper housing. Hair shield 40 is located on handle 12 on exterior surface 42 near cutting end 30 to block and/or removes cut hair follicles away from blade assembly 14, motor 28, and/or internal cavity 33. In one embodiment, hair shield 40 is a concave surface on upper housing 24 configured to scoop the hair follicles as they are cut nearby by blade assembly 14. In various embodiments, hair shield 40 extends along upper housing 24 in the direction of axial axis 50 at least one inch, specifically, at least 1.1 inches, and more specifically at least 1.15 inches. This extension along axial axis 50 and/or the concave depth of hair shield 40 defines a surface area of at least 2.5 $in^2$. For example, hair shield 40 extends at least 90% of a maximum width W2 across handle 12 to protect internal cavity 33 and motor 28.

The concave hair shield 40 has an exterior surface 42 on upper housing 24 that captures debris and protects motor 28 from separated hair follicles. Motor 28 is located near blade assembly 14 at cutting end 30 of handle 12 to balance the components' weight in clipper 10. For example, a clamshell handle 12 can change the concave recess of the exterior surface 42 formed between upper housing 24 and the lower housing 26.

In various embodiments, handle length L1 is between 5 inches and 7 inches, specifically, between 5.5 inches and 6.5 inches, and more specifically, between 5.75 inches and 6.25 inches. In various embodiments, lower housing length L2 is between 4 inches and 5.5 inches, specifically between 4.5 inches and 5 inches. In one embodiment, lower housing length L2 is 4.75+/−0.05 inches. Blade surface 88 has a width W1 dimension of between 1.6 inches and 1.9 inches, specifically, between 1.7 inches to 1.8 inches. Similarly, blade surface 88 has a height H1 dimension extending at an angle to height H1 and axial axis 50 of clipper 10. In various embodiments, the height H1 dimension of blade surface 88 is between 1.5 inches and 1.8 inches, specifically between 1.6 inches and 1.7 inches.

Similarly, a handle height H1 is defined in an orthogonal direction to axial axis 50 between a top surface or top side 52 and a bottom surface or bottom side 54 of handle 12. A height taper 60 measures the relative change between the maximum height H2 (near the cutting end 30) and the base height H3 (e.g., measured at the gripping end 34). In one embodiment, height taper 60 is a linear height taper 60 between maximum height and base height H3. In this configuration, an angle (e.g., in degrees or radians) formed between top side 52 and bottom side 54 defines height taper 60. In various embodiments, height taper 60 forms an angle between top side 52 and bottom side 54 between 3° and 7°, specifically between 4° and 6°, more specifically between 4.5° and 5°.

In various embodiments, maximum height H2 of handle 12 is between 1.4 inches and 1.8 inches, specifically, between 1.5 inches and 1.7 inches, and more specifically, between 1.6 inches and 1.65 inches. In various embodiments, base height H3 is between 0.8 inches and 1.3 inches, specifically, between 0.9 inches and 1.2 inches, and more specifically between 1 inch and 1.1 inches.

Height taper 60 is a relative comparison of maximum height H2 and base height H3. The reduction (e.g., ratio or percentage) from the maximum height H2 to achieve the base height H3 defines the height taper 60. As a specific example, when maximum height H2 is equal to or greater than 1.6 inches and base height H3 is equal to or less than 1.1 inches, the height taper 60 is at least 68.75%. In this case, height taper is defined as 1.1/1.6 in/in (e.g., 1.1:1.6 in/in), at a minimum. In various embodiments, the maximum height H2 is greater than 1.6 inches, and base height H3 (e.g., at gripping end 34 of handle 12) is less than 1.1 inches, such that height taper 60 is 69% or less.

Similarly, a handle width W1 is defined in an orthogonal direction to axial axis 50 between a left side 90 and a right side 92 of handle 12 (e.g., left and right surfaces). A width taper 62 measures the relative change between the maximum width W2 near cutting end 30 and base width W3, measured at gripping end 34. In one embodiment, width taper 62 is a linear width taper 62 between maximum width W2 and base width W3. An angle formed between left side 90 and right side 92 describes width taper 62 in this configuration. In various embodiments, width taper is between 4° and 8°, specifically between 5° and 7°, and more specifically, between 6° degrees and 6.5° degrees.

In various embodiments, maximum width W2 is between 1.5 inches and 2 inches, specifically, between 1.6 inches and 1.9 inches, and more specifically, between 1.7 inches and 1.8 inches, and even more specifically, between 1.75 inches and 1.8 inches. In various embodiments, base width W3 is between 1 inch and 1.5 inches, specifically between 1.1 inches and 1.4 inches, more specifically, between 1.2 inches and 1.3 inches, and even more specifically between 1.22 inches and 1.26 inches.

Width taper 62 is a relative comparison of maximum width W2 and base width W3. The reduction of maximum width W2 to achieve the base width W3 defines the width taper 62. In various embodiments, maximum width W2 is greater than 1.7 inches, and a width at the handle end is less than 1.3 inches, such that the width taper is 76% or less. As a specific example, when the maximum width W2 is 1.8. inches or more and base width W3 is 1.2 inches or less, width taper 62 is at least 1.2/1.8 in/in (e.g., 1.2:1.8 in/in) or approximately 66.6%. Compared to the previous height example with a height taper 60 of 68.75%, which is greater than the 66.6% width reduction, the handle 12 is said to have a greater height taper 60 than width taper 62. Applicant has found that by providing a higher height reduction than width reduction, a larger top side 52, and narrower left/right sides 90 and 92 are created in handle 12, to improve grasp at gripping end 34 of handle 12. In other words, the reduction of width taper 62 is greater than the reduction of height taper 60 to facilitate user grip on handle 12 for extended durations.

When width taper 62 is linear, an angle measure of width taper 62 is made by comparing the angle formed between the left side 90 and right side 92 of handle 12. In various embodiments, width taper 62 is between 4° and 8°, specifically, between 5° and 7°. The width taper 62 defines a 6.0° angle (+/−0.5°).

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements. The position of elements may be reversed or otherwise varied, and the nature or number of discrete elements or positions may be altered or varied. Other substitutions, modifications, changes, and omissions may also be made in the design, operating conditions, and arrangement of the various exemplary embodiments without departing from the present invention's scope.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths, and radii, are to scale as shown in the Figures. The figures' actual measurements will disclose relative dimensions, angles, and proportions of the various exemplary embodiments. Various exemplary embodiments extend to various ranges around the absolute and relative dimensions, angles, and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A haircutter, comprising:

a blade assembly defining a cutting end of the haircutter and having a stationary blade and an oscillating blade that oscillates cutting teeth over the stationary blade to cut hair; and a handle, having:

an upper housing having a spiral exterior surface including spiral ridges, wherein the spiral ridges have an orientation at an angle relative to an axial axis of the handle;

a lower housing having a spiral exterior surface including spiral ridges, wherein the spiral ridges have an orientation at an angle relative to the axial axis of the handle such that the spiral exterior surface of the lower housing aligns with the spiral exterior surface of the upper housing to define a handle gripping end opposite the blade assembly at the cutting end;

a base defined at the handle gripping end;

wherein the lower housing couples to the upper housing to define a height taper and a width taper, wherein the height taper is defined as a reduction from a maximum height to a height at the base of the handle gripping end between the upper housing and the lower housing, and the width taper is defined as the reduction of a maximum width of the handle between the upper housing and the lower housing to a width at the base of the handle gripping end; and wherein the width at the base is between 5% and 10% greater than the height at the base, and wherein the width taper is greater than the height taper, such that the width of the handle is reduced more than the height of the handle.

2. The haircutter of claim 1, wherein the maximum width is greater than 1.7 inches, and the width at the base of the handle gripping end is less than 1.3 inches, such that the width taper is less than or equal to 77%.

3. The haircutter of claim 1, wherein the maximum height is greater than 1.6 inches, and the height at the base of the handle gripping end is less than 1.1 inches, such that the height taper is less than or equal to 69%.

4. The haircutter of claim 1, further comprising a rotary motor, wherein the rotary motor and the blade assembly are captured behind the blade assembly, and wherein the rotary motor is captured in a front 45% of the handle at the cutting end opposite the handle gripping end.

5. The haircutter of claim 1, further comprising an electric charging port at the handle gripping end and a battery within an internal cavity, wherein the electric charging port is electronically coupled to the battery in the internal cavity and captured in the handle gripping end of the upper housing and the lower housing.

6. The haircutter of claim 1, further comprising a circular power button on the upper housing, the circular power button having a diameter less than or equal to 0.5 inches.

7. The haircutter of claim 1, wherein the spiral exterior surface of the upper housing and the lower housing includes an alternating spiral groove between the spiral ridges, and wherein a spacing of the spiral groove is defined as a distance between adjacent spiral ridges and the spacing of the spiral groove is equal to a thickness of each of the spiral ridges.

8. The haircutter of claim 1, wherein the spiral exterior surface of the upper housing and the lower housing has a spiral groove, and wherein a spacing of the spiral groove and a thickness of each of the spiral ridges are each less than or equal to 0.05 inches.

* * * * *